US006385820B1

(12) United States Patent
Hrominchuk

(10) Patent No.: US 6,385,820 B1
(45) Date of Patent: May 14, 2002

(54) HOSE STRANGLER

(75) Inventor: Len Hrominchuk, Thunder Bay (CA)

(73) Assignee: Wildfire Fire Equipment Inc., Lachine (CA)

( * ) Notice: Subject to any disclaimer, the term of this patent is extended or adjusted under 35 U.S.C. 154(b) by 0 days.

(21) Appl. No.: 09/436,731

(22) Filed: Nov. 8, 1999

(30) Foreign Application Priority Data

Apr. 20, 1999 (CA) ..... 2268416

(51) Int. Cl.[7] ..... A44B 21/00

(52) U.S. Cl. ..... 24/273; 24/24; 24/68 CD; 24/285; 24/543

(58) Field of Search ..... 24/273, 274 P, 24/285, 543, 24, 20 CW, 68 C, 68 CD, 69 R, 909

(56) References Cited

U.S. PATENT DOCUMENTS

| | | | | | |
|---|---|---|---|---|---|
| 2,390,801 | A | * | 12/1945 | Markey | 24/273 |
| 2,746,064 | A | * | 5/1956 | Ausmus | 24/273 |
| 3,405,429 | A | * | 10/1968 | Vazquez | 24/543 |
| 3,828,403 | A | * | 8/1974 | Perrin et al. | 24/273 |
| 4,382,453 | A | * | 5/1983 | Bujan et al. | 24/543 |
| 4,969,923 | A | * | 11/1990 | Reeder et al. | 24/273 |

OTHER PUBLICATIONS an extract from Wajax Fire Control Equipment, catalog 76 (undated) showing two different hose clamps.
an extract from Wajax Pacific Pumpers Inc., catolog, showing shut–off clamps and undated.
an extract from W.S. Darley & Co., catalog No. 219, undated, showing a hose clamp.
an extract from W.S. Darley & Co., catalog No. 224, showing hose clamps.
an extract from Western Fire Equipment Company, catalog No. 86, dated 1979, showing a variety of different hose clamps.
an extract from Akron, catalog No. 106, showing hose clamps and dated 1987.
an extract from Akron, catalog No. 105, also showing hose clamps and dated 1984; and.
and extract from Akron Brass, catalog 109, showing hose clamps and dated 1999.

* cited by examiner

*Primary Examiner*—Victor N. Sakran
(74) *Attorney, Agent, or Firm*—Darby & Darby

(57) ABSTRACT

Disclosed is a hose strangler which considerably reduces the risk of slippage when the strangler is being removed from the hose. The hose strangler includes a clamping member adapted to hold a hose in position. The clamping member has a first arm having a concave portion for receiving the hose and a second arm having a convex portion matching the concave portion of the first arm, the concave and convex portions defining a hose strangling area, where the first and second arms are pivotally secured at a first end so as to permit the clamping member to rotate between a closed position and an opened position. A blocking mechanism to open and close an opening between the first and second arms is also provided, where the blocking mechanism is located in the hose strangling area. A locking mechanism is also provided for securing the clamping member in a closed position. In use, when after the hose has been strangled and the necessary work done, the opening between the first and second arms is open so as to equalize the pressure on both sides of the hose. Once the pressure has been equalized, the locking mechanism can be unlocked and the hose strangler removed safely and without causing any injury.

3 Claims, 8 Drawing Sheets

HOSE STRANGLER

FIELD OF THE INVENTION

The present invention relates to hose stranglers.

DESCRIPTION OF THE PRIOR ART

Hose stranglers are used extensively in forestry and municipal fire fighting applications. The fundamental use of a hose strangler is to momentarily stop the flow of water through the hose in order to change a nozzle, repair a hose, add hose length, change or add adapters, etc. without having to stop a pump and engine. Hence, this hose adapter provides a fast and easy way to make the above changes in an emergency situation.

Various existing hose stranglers are presently available. One type of well known strangler is called the flat strangler. This strangler has two flat portions working as a clip. In use, the hose is placed between the flat portions and these are then brought together and secured by an attaching mean.

Another well known strangler device is a V-shape strangler. The V-shape strangler was developed to improve the flat hose strangler, specifically to reduce the problem of hose pinching (snake eye) and strangler slippage.

Although they are industry accepted safe stranglers, the existing stranglers do have a problem when the user wants to remove the strangler from the hose. This is because, while the strangler is secured on the hose, water pressure builds up on one side of the strangler, whereas on the other side, water pressure is near zero. Slippage is then possible and makes the removal of the strangler a hazardous operation. More specifically, it has been noted that slippage occurs mostly when the operator is removing the strangler. At this time, there is no maximum compression on the hose to firmly maintain the strangler in place. Therefor, there is a risk, when opening the strangler, that the build up of pressure will tear the strangler from the user's hand and fly off.

One solution to this problem has been to propose rubber shoes or pads on the inside of the strangler to increase friction, but this does not completely resolve the issue.

Slippage is also a concern when dealing with hoses made with aramid fibres, since these types of hoses are more slippery, and the risk of injury is greater.

Hence, there is a need to provide a new hose strangler that will circumvent the above identified problems that is to prevent slippage, thereby preventing any risk of injury during operation of the hose strangler.

SUMMARY OF THE INVENTION

It is thus an object of the invention to propose a hose strangler which considerably reduces the risk of slippage when the strangler is being removed from the hose.

In accordance with the present invention, this object is achieved with a hose strangler comprising:

- a clamping member adapted to hold a hose in position, said clamping member comprising
  - a first arm having a concave portion for receiving said hose,
  - a second arm having a convex portion matching said concave portion of said first arm, said concave and convex portions defining a hose strangling area, said first and second arms being pivotally secured at a first end so as to permit said clamping member to rotate between a closed position and an open position,

- a blocking means to open and close an opening between said first and second arms, said blocking means being located in said hose strangling area; and
- a locking mechanism for securing said clamping member in a closed position.

BRIEF DESCRIPTION OF THE DRAWINGS

The present invention and its advantages will be more easily understood upon reading the following non-restrictive description of preferred embodiments thereof, made with reference to the following drawings in which.

DESCRIPTION OF A PREFERRED EMBODIMENT OF THE INVENTION

Figure 1:
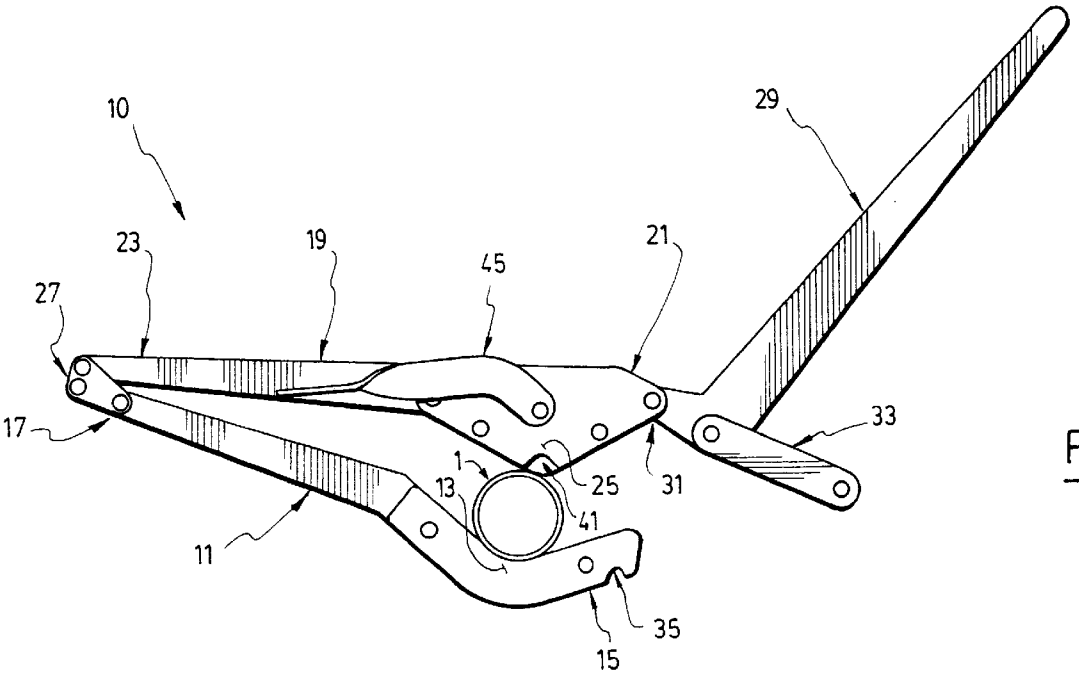
FIGS. 1 to 4 show the steps for strangling a hose with a hose strangler according a preferred embodiment of the present invention.

Referring to FIGS. 1 to 11, which are not to scale, the hose strangler 10 according to the present invention comprises a lower arm 11 and an upper arm 19. The lower arm has two opposite ends 15, 17 and a concave portion 13 near a first opposite end 15. The upper arm 19 has two opposite ends 21, 23 and a convex portion 25 near a first opposite end 21. The convex portion 21 is shaped to mate with the concave portion 13 of the lower arm 11 when the hose strangler is in a closed position (shown in FIG. 4).

Figure 4:
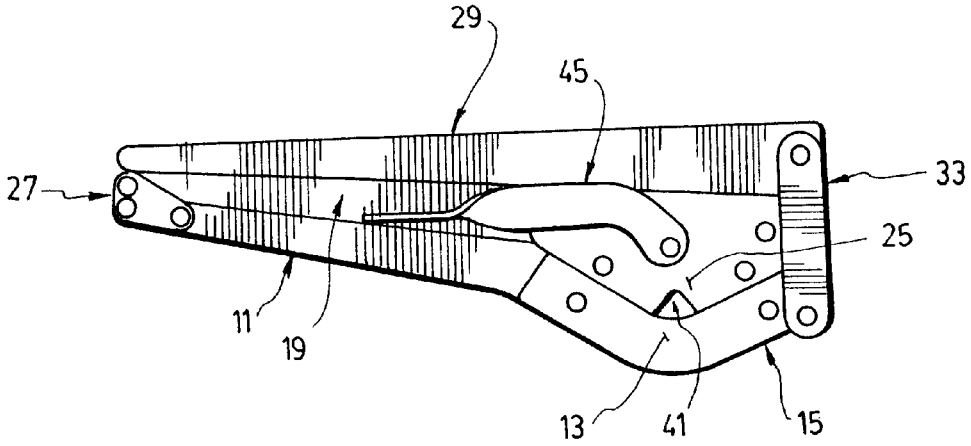

Still referring to FIG. 1, the hose strangler further comprises a middle arm 29 pivotally fastened to the upper arm 19 at a pivot point 31. A side link 33 is mounted on a portion of the middle arm 29 for engagement with a notch 35 in the end 15 of the lower arm 11 in order to secure said upper arm and said lower arm together when said hose strangler 10 is in a closed position (FIG. 4).

As can be seen throughout FIGS. 1 to 7, the second opposite end 23 of the upper arm 19 is pivotally connected to the second opposite end 17 of the lower arm 11 by a pivot 27. This allows the hose strangler to rotate between an open and closed position.

Referring now to FIGS. 1 to 4, are shown the steps for strangling a hose 1 with the hose strangler 10 of the present invention.

Figure 2:
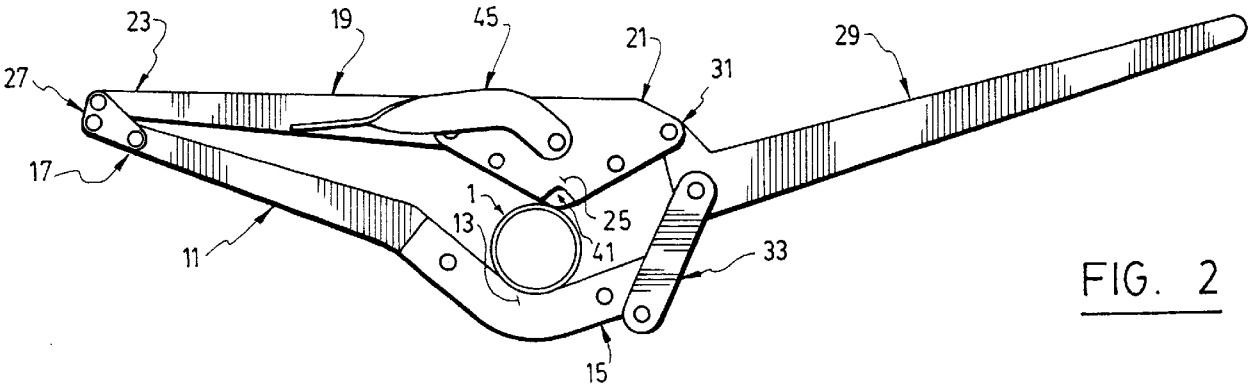

As can be seen in FIG. 2, once the hose 1 is installed between the upper and lower arms 19, 11 of the hose strangler 10, the side link 33 is hooked on the notch 35 located at the first end 15 of the lower arm 11.

Figure 3:
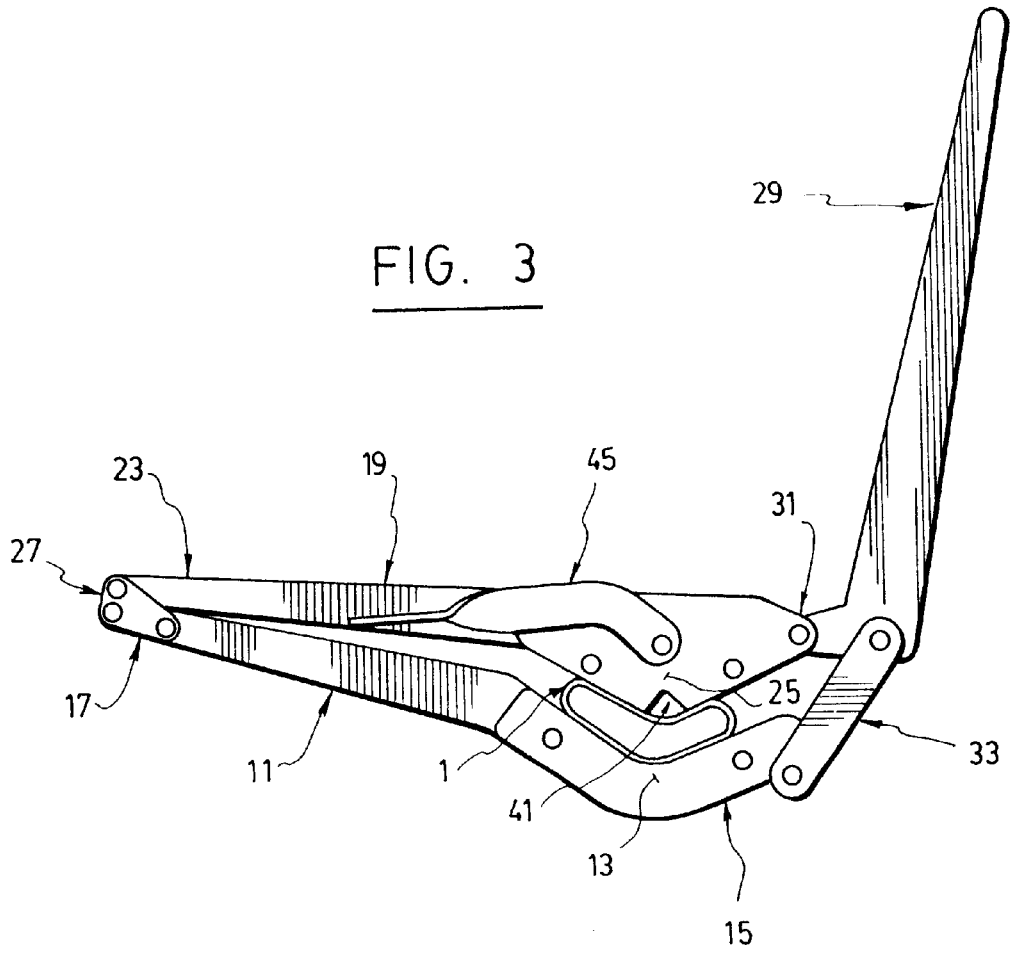

As shown in FIG. 3, once the side link 33 is secured on the lower arm 11 of the hose strangler 10, the middle arm 29 is rotated towards the upper arm 19 until it reaches a position parallel to the upper arm 19. This is the closed position and it is shown in FIG. 4. This position effectively strangles the hose between the upper 19 and lower 1 1 arms in the concave portion 13.

In this closed position, it is now possible to work on the hose, that is to proceed with the replacement of a hose section or a nozzle. Once the work is completed it is possible to remove the hose strangler 10. One of the main aspects of the invention is to provide means for equalizing the pressure on both sides of the strangler, in order to permit safe opening of the strangler by first equalising the water pressure on both sides of the hose 1.

In accordance with the invention, means are provided for opening an area between the concave and convex portions 13, 25.

Figure 8:
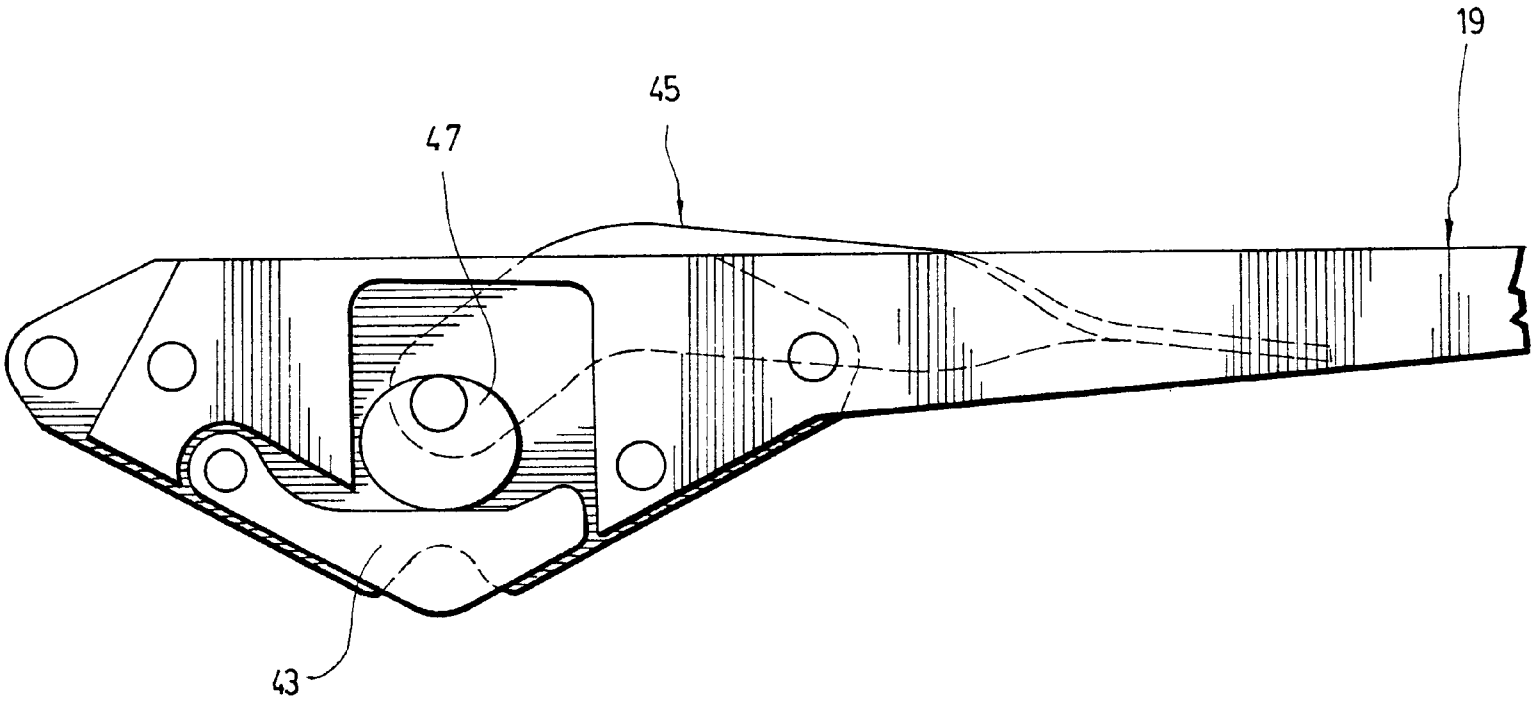
FIG. 8 shows a detailed view of a portion of the hose strangler of FIGS. 1 to 4 for opening an area between the concave and convex portions of said hose strangler.
Figure 9:
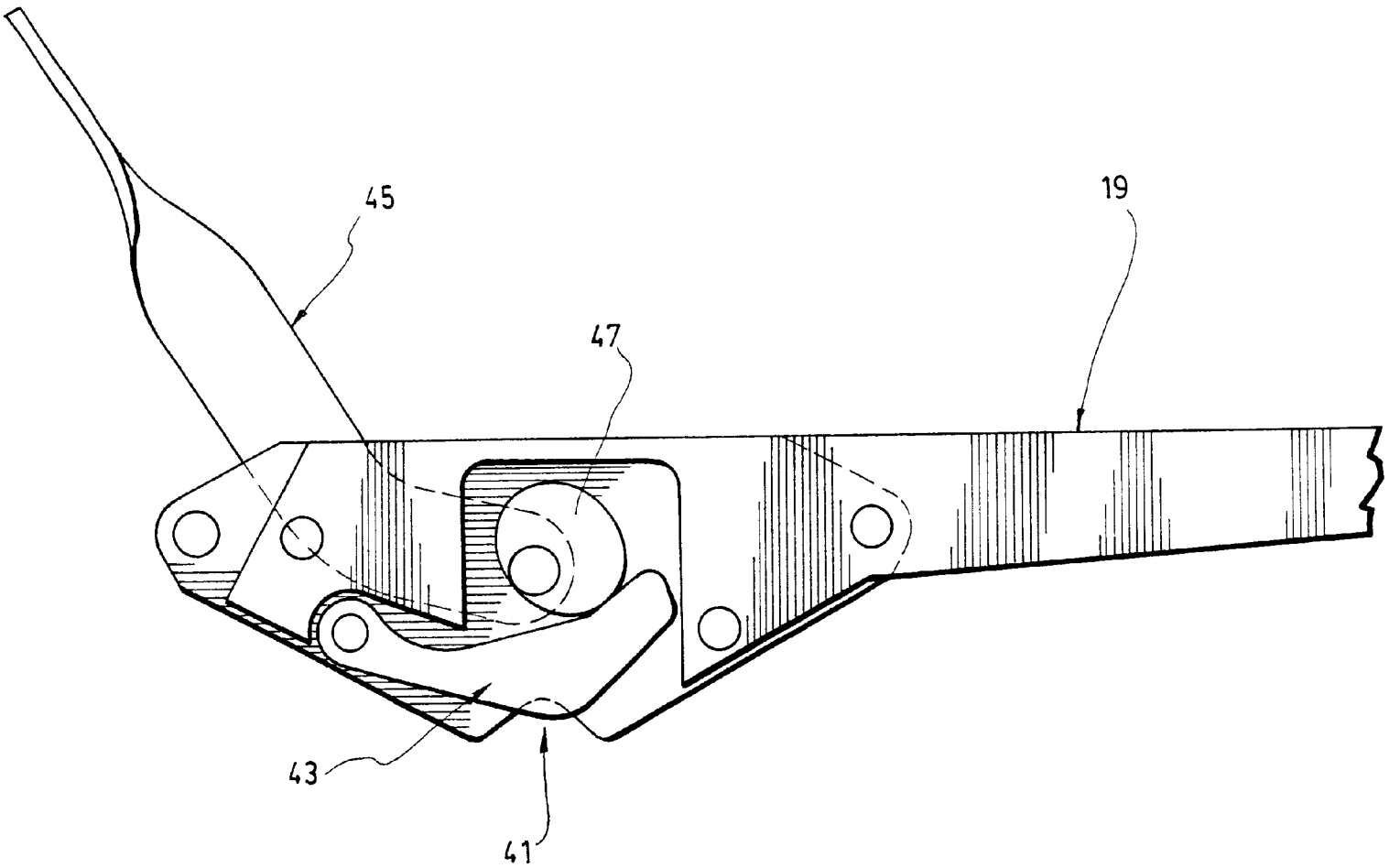
FIGS. 9 and 10 show a side view of the means for opening an area between the concave and convex portions according to the invention, said means being in the unlocking position.
Figure 10:
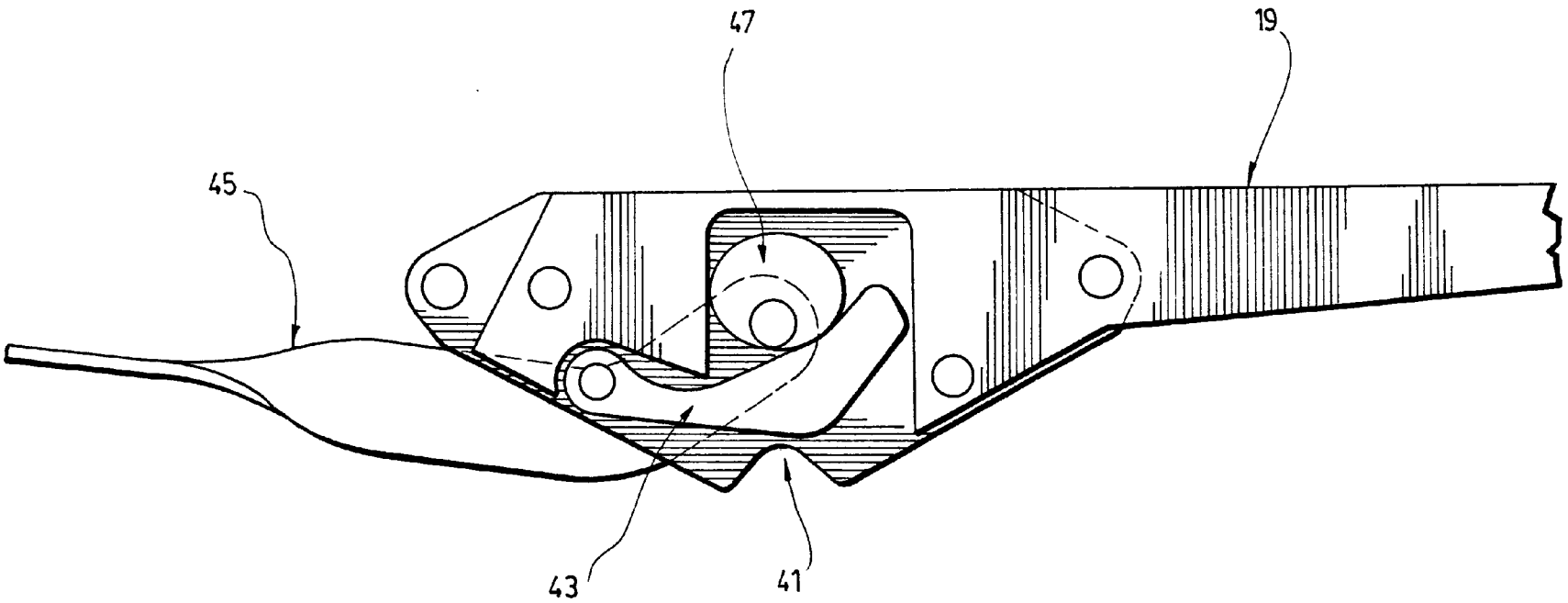
Figure 11:
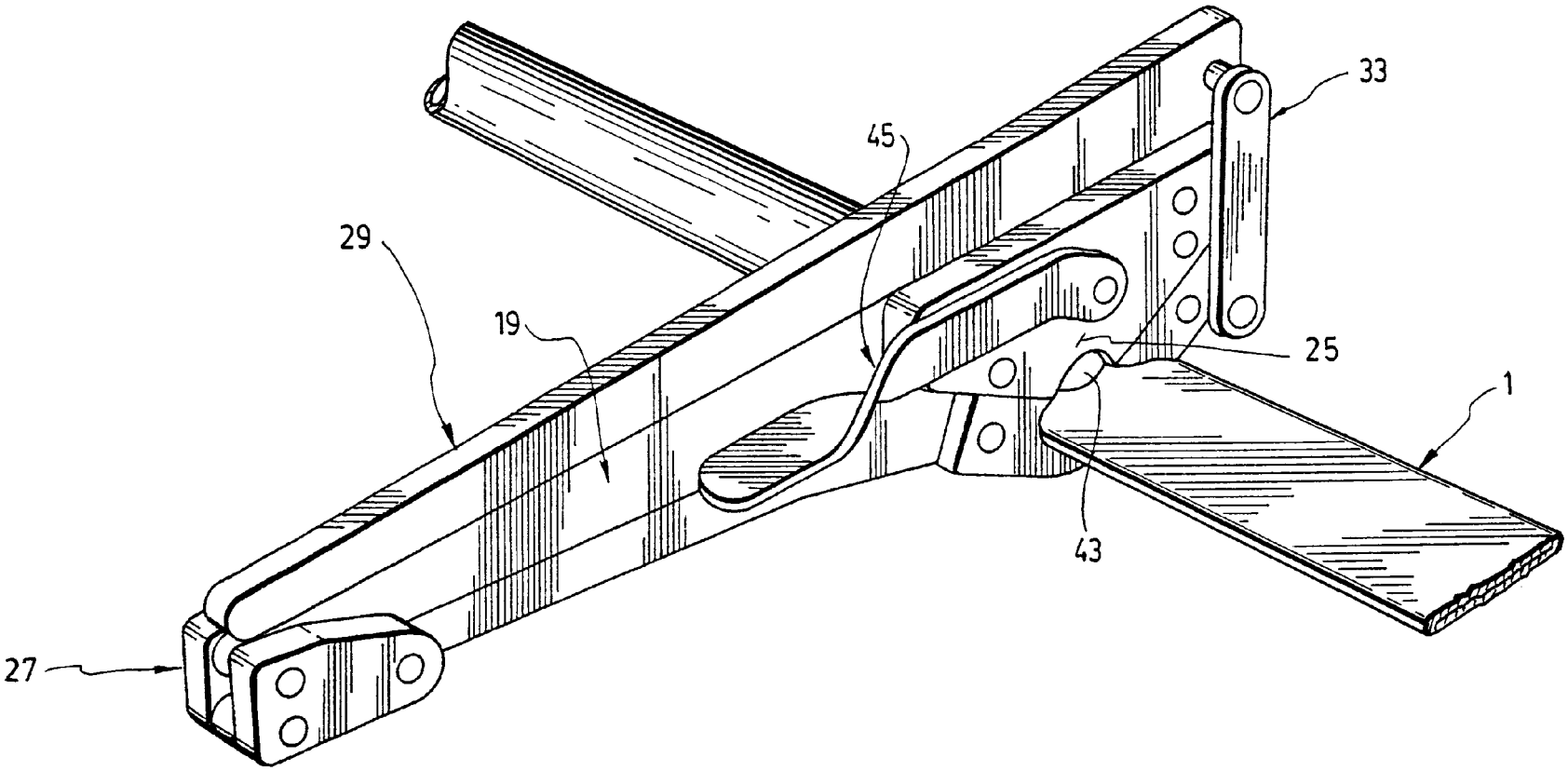
FIG. 11 is a perspective view of a hose strangler according to FIG. 1.

As shown in FIGS. 8, 9 and 10, the means for opening an area are preferably located on the upper arm 19. The means consist of an indent 41 where would have been the apex of the convex portion 25 were it not for the invention. Pivotally attached to the convex portion 25 (and preferably sandwiched between two identical pieces forming the convex portion, only one of which is shown in FIGS. 8 to 10) is a lever 43 and a cam arm 45. The cam arm 45 is further provided with a cam 47 which serves to press against the lever 43.

As can be seen in FIGS. 8 to 10, the lever 43 can be pivoted between an open (FIG. 10) and a closed (FIG. 8) position. In the closed position, the cam arm 45 is in the locked position lies substantially parallel to the upper and lower arms 11, 19. In this position, the cam 47 presses down against the cam arm 45 In this position, the water circulation is completely cut and water pressure is at a maximum on one side of the strangler and almost zero on the other side. Thus it is possible to replace a hose section or nozzle on the side without water pressure.

In order to equalize the pressure once the necessary work has been performed, the cam arm 45 is first rotated away from upper and lower arms 19, 11, as shown in FIG. 9, the cam 47 is first released and the lever 43 is automatically disengaged from its closed position due to the water pressure. This lets the water flow through the strangler through the opening formed by the indent 41 and thus gradually equalise the water pressure on both sides of the strangler.

Once the pressure has been sufficiently equalised, the middle arm 19 is pivoted outwardly to disengage the link 33 from the notch 35, which then enables the strangler 10 to be opened. This last step is done safely without risk of injury since the water pressure is evenly distributed on both sides of the strangler, and therefore there is no risk of slippage.

Figure 5:
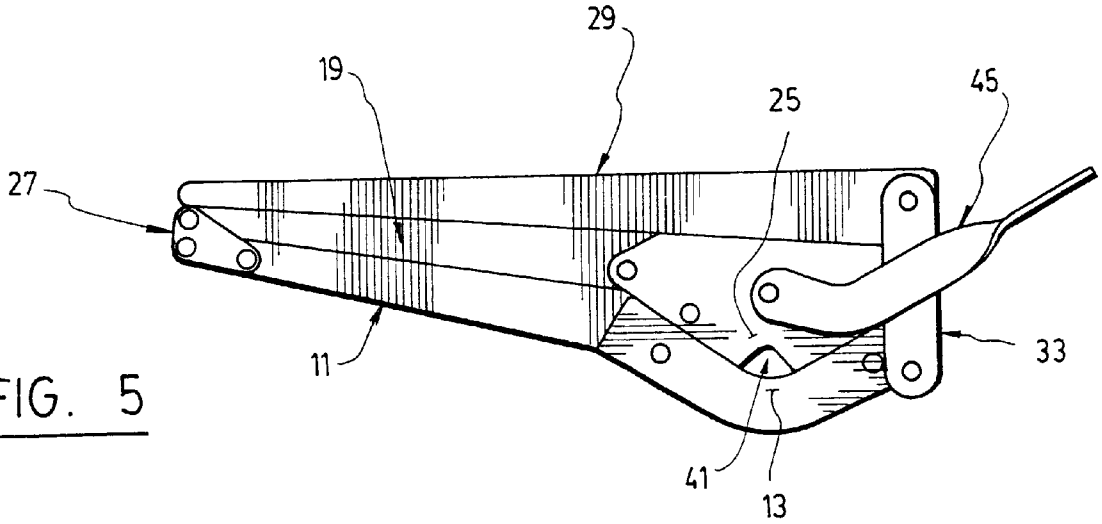
FIGS. 5 to 7 show the steps for releasing the hose strangler of FIGS. 1 to 4 from the a hose.
Figure 6:
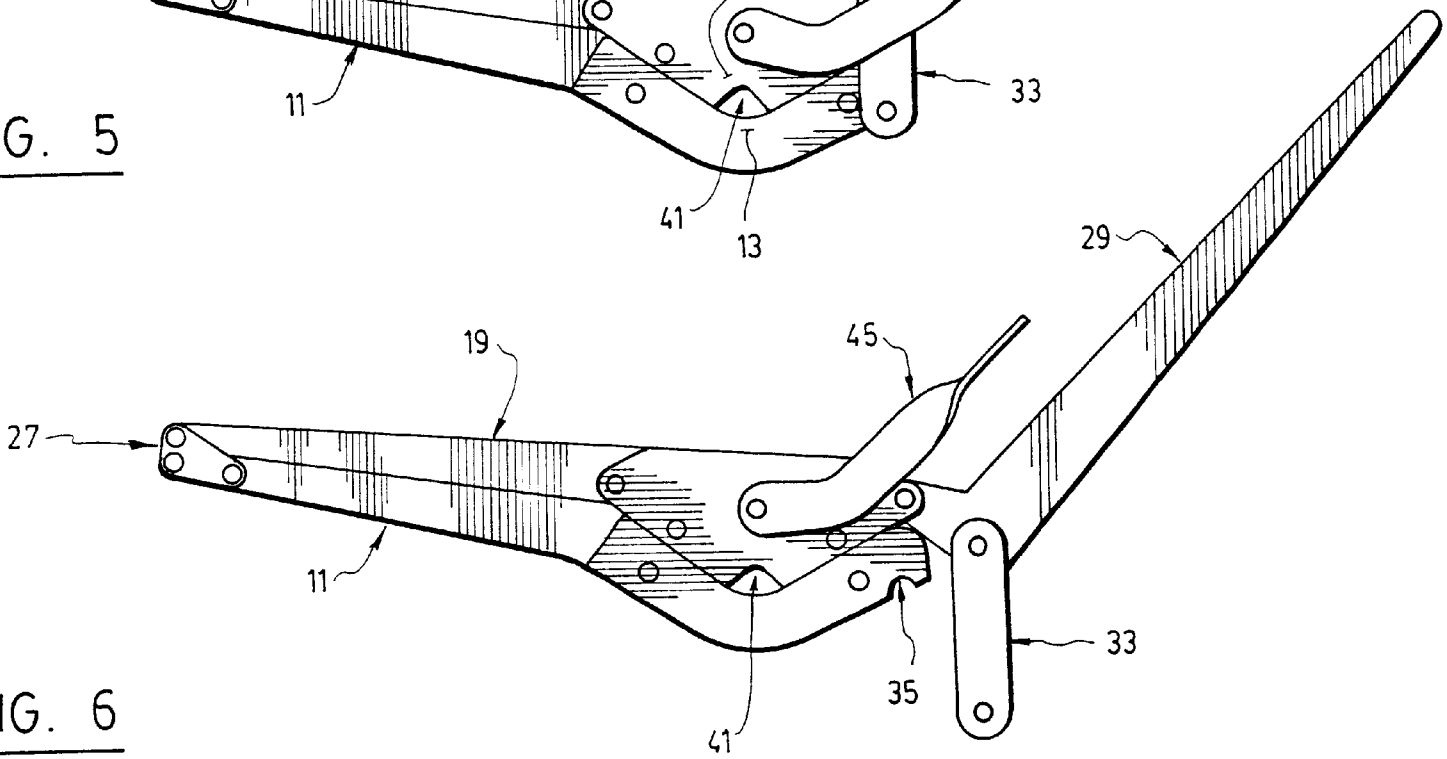

Hence, referring to FIGS. 5 and 6, to open the hose strangler 10, the middle arm 29 is first rotated to an open position, that is, it is rotated away from the upper and lower arms 19, 11. Once the middle arm 29 is at the open position, the side link 33 may be released from the hook 35 located at the first end 15 of the lower arm 11.

Figure 7:
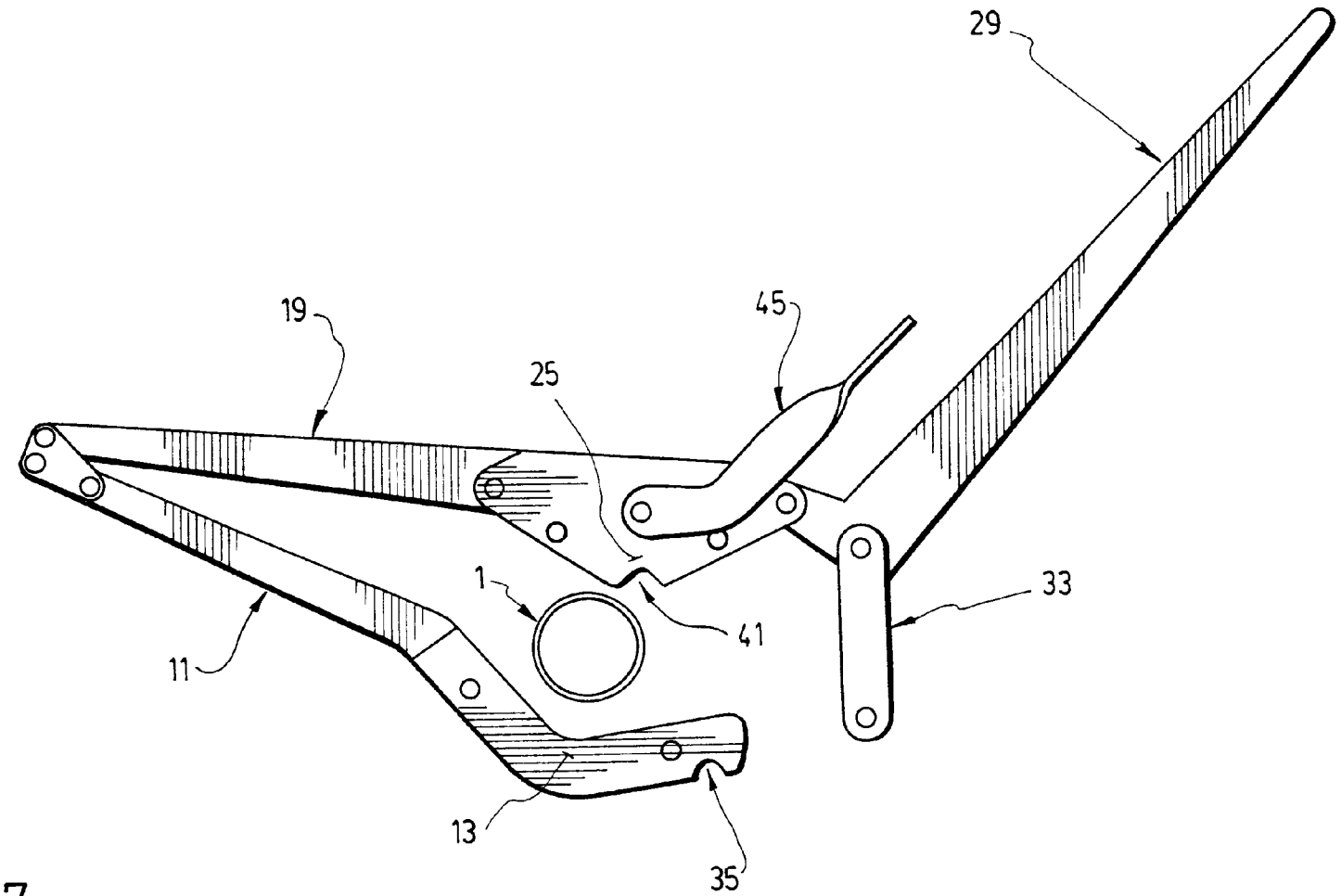

Finally, as shown in FIG. 7, the hose strangler is completely opened by rotating the upper arm 19 away from the lower arm 11. In this position, the hose 1 may be readily released from the hose strangler 10.

Although the present invention has been explained hereinabove by way of a preferred embodiment thereof, it should be pointed out that any modifications to this preferred embodiment within the scope of the invention is not deemed to alter or change the nature and scope of the present invention.

What is claimed is:

1. A hose strangler comprising a clamping member adapted to hold a hose in position, said clamping member comprising a first arm having a concave portion for receiving said hose, a second arm having a convex portion matching said concave portion of said first arm and said convex portion having an indented portion with a longitudinal cavity, said concave and convex portions defining a hose strangling area, said first and second arms being pivotally secured at a first end to permit said clamping member to rotate between a closed position and an open position, a blocking means to open and close an opening between said first and second arms, said blocking means located in said hose strangling area and including a lever having a concave shape matching said convex portion of said second arm, said lever being pivotally mounted within said longitudinal cavity to pivot between a closed position and an open position, where in the closed position said lever is locked by said blocking means so that said lever projects toward said concave portion of said first arm and obstructs said opening and where in the open position said lever is released from said blocking means and permitted to pivot away from the concave portion of said first arm to clear said opening where said indented portion defines said opening; and a locking mechanism for securing said clamping member in a closed position.

2. A hose strangler according to claim 1, wherein said locking mechanism comprises a middle arm mounted to a second end of said second arm and a side link having one end adapted to be mounted on a portion of said middle arm and an opposite end adapted to be attached to a hook at a second end of said first arm.

3. A hose strangler according to claim 2, wherein said blocking means includes a cam mechanism for allowing said lever to rotate between the closed and open positions, said cam mechanism comprising:

a cam arm pivotally mounted on an end portion of said first arm so as to rotate between a first and second position, wherein at said first position, said cam arm lies parallel to said first and second arms in the closed position, and at the second position, said cam arm defines an angle with respect to said first and second arms in the closed position; and a cam mounted between said lever and cam arm for pressing said cam against a contact surface of said lever, said cam rotating about a cam axis, so that when said cam arm is in the first position, said contact surface of said lever is at a furthest position from said cam axis so as to allow said cam to press against said lever thereby allowing said lever to be locked in the closed position and when said cam arm is in the second position, said cam is released from said lever and said contact surface of said lever is in a closed position from said cam axis and said lever is unlocked and free to rotate to the open position.

* * * * *